US006286830B1

(12) United States Patent
Kitahara et al.

(10) Patent No.: US 6,286,830 B1
(45) Date of Patent: Sep. 11, 2001

(54) SHEET MATERIAL STACKING DEVICE AND IMAGE FORMING APPARATUS HAVING SAME

(75) Inventors: Yoshihiko Kitahara, Yokohama; Teruo Komatsu; Yasuyoshi Hayakawa, both of Mishima; Tomoyuki Araki, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/314,171

(22) Filed: May 19, 1999

(30) Foreign Application Priority Data

May 22, 1998 (JP) ..... 10-141913

(51) Int. Cl.[7] ..... B65H 31/20

(52) U.S. Cl. ..... 271/223; 271/3.03; 271/3.13; 271/3.17; 271/220; 271/225

(58) Field of Search ..... 271/3.13, 3.17, 271/225, 3.03, 141, 171, 223, 220

(56) References Cited

U.S. PATENT DOCUMENTS 5,586,758 * 12/1996 Kimura et al. ..... 271/303

* cited by examiner

*Primary Examiner*—Donald P. Walsh
*Assistant Examiner*—Mark J. Beauchaine
(74) *Attorney, Agent, or Firm*—Fitzpatrick, Cella, Harper & Scinto

(57) ABSTRACT

The present invention provides a sheet material stacking device comprising a sheet material discharging means for discharging a sheet material, a sheet material stacking means on which the sheet materials discharged by the sheet material discharging means are stacked, and an elongation tray extensibly housed within the sheet material stacking means and capable of extending in accordance with a size of the sheet material, and wherein the elongation tray has an inclined surface at an upstream end thereof in a sheet material stacking direction.

13 Claims, 7 Drawing Sheets

SHEET MATERIAL STACKING DEVICE AND IMAGE FORMING APPARATUS HAVING SAME

BACKGROUND OF THE INVENTION

1. Field of the Invention

The present invention relates to a sheet material stacking device, and more particularly, it relates to a sheet material stacking device having a function for stacking sheet materials on a stacking tray and applicable to an image forming apparatus such as a copying machine, a printer, a facsimile and the like.

2. Related Background Art

In conventional image forming apparatuses such as copying machines, printers, facsimiles and the like, there is provided a stacking tray on which sheet materials discharged from a main body of the image forming apparatus are stacked, and an example of such an image forming apparatus is shown in FIG. 6. In FIG. 6, the reference numeral 201 denotes a main body of the image forming apparatus; 210 denotes a sheet material stacking device; and 222, 251, 252, 253, 254 and 255 denote stacking trays on which sheet materials discharged and sorted from the sheet material stacking tray 210 are stacked. In order to minimize the installation space of the system, the stacking trays 251 to 255 include extensible/retractable extension trays 261 to 265, respectively.

However, the above-mentioned conventional example has the following problems.

That is to say, thicknesses of the stacking trays 251 to 255 must be increased to hold the extension trays 261 to 265 therein. More particularly, the thickness of each stacking tray is required to be not less than 12 mm.

Particularly when the number of the stacking trays is increased, the total height of the apparatus will be increased accordingly. To avoid this, there has been proposed a technique in which each of extension trays 361 is disposed at one side (upper side) of each of the stacking trays 351, 352, as shown in FIG. 7. However, with this arrangement, a leading end of a sheet material 300 discharged from a main body 210 by a pair of rollers 353 of an image forming apparatus may be caught by an upstream end 361*a* of the extension tray 361.

Further, when the stacking trays are arranged conversely (i.e., the extension trays are disposed at lower sides of the stacking trays), if an upwardly curled sheet material is discharged onto the extension tray of the lower stacking tray, the leading end of the sheet material may be caught by the upstream end of the extension tray of the upper stacking tray, thereby causing the sheet jam.

SUMMARY OF THE INVENTION

An object of the present invention is to provide a sheet material stacking device in which thicknesses of sheet material stacking means are reduced and a discharged sheet material is prevented from being caught thereby to increase stacking ability.

The present invention aims to eliminate the above-mentioned conventional drawbacks, and an object of the present invention is to provide a sheet material stacking device comprising a sheet material discharging means for discharging a sheet material, a sheet material stacking means on which the sheet materials discharged by the sheet material discharging means are stacked, and an extension stacking means extensibly housed within the sheet material stacking means and capable of extending in accordance with a size of the sheet material, and wherein the extension stacking means has an inclined surface at an upstream end thereof in a sheet material stacking direction.

A further object of the present invention is to provide a sheet material stacking tray arrangement comprising a stacking tray on which sheet materials are stacked, and an extension tray extensibly held in the stacking tray, and wherein the extension tray has an inclined surface at an upstream end thereof in a sheet material stacking direction.

With the above-mentioned construction, when the sheet material is discharged by the sheet material discharging means onto the sheet material stacking means, if a size of the sheet is great, the extension stacking means is drawn from the sheet material stacking means to provide an extension tray. Since the extension stacking means has the inclined surface at its upstream end, even if a leading end of the discharged sheet material contacts with the upstream end of the extension stacking means, the leading end of the sheet material is slid on the inclined surface to be smoothly rested on the sheet material stacking means. In this way, the sheet materials can be stacked on the sheet material stacking means stably without increasing the thickness of the sheet material stacking means and with preventing the leading end of the sheet material from being caught by the extension stacking means.

DETAILED DESCRIPTION OF THE PREFERRED EMBODIMENTS

The present invention will now be fully explained in connection with a preferred embodiment thereof with reference to the accompanying drawings. Incidentally, in the following embodiment, a sheet material stacking device used with an image forming apparatus such as a copying machine will be described as an example.

[Construction of Image Forming Apparatus]

First of all, a schematic construction of the image forming apparatus will be briefly described with reference to FIG. 3.

Figure 3:
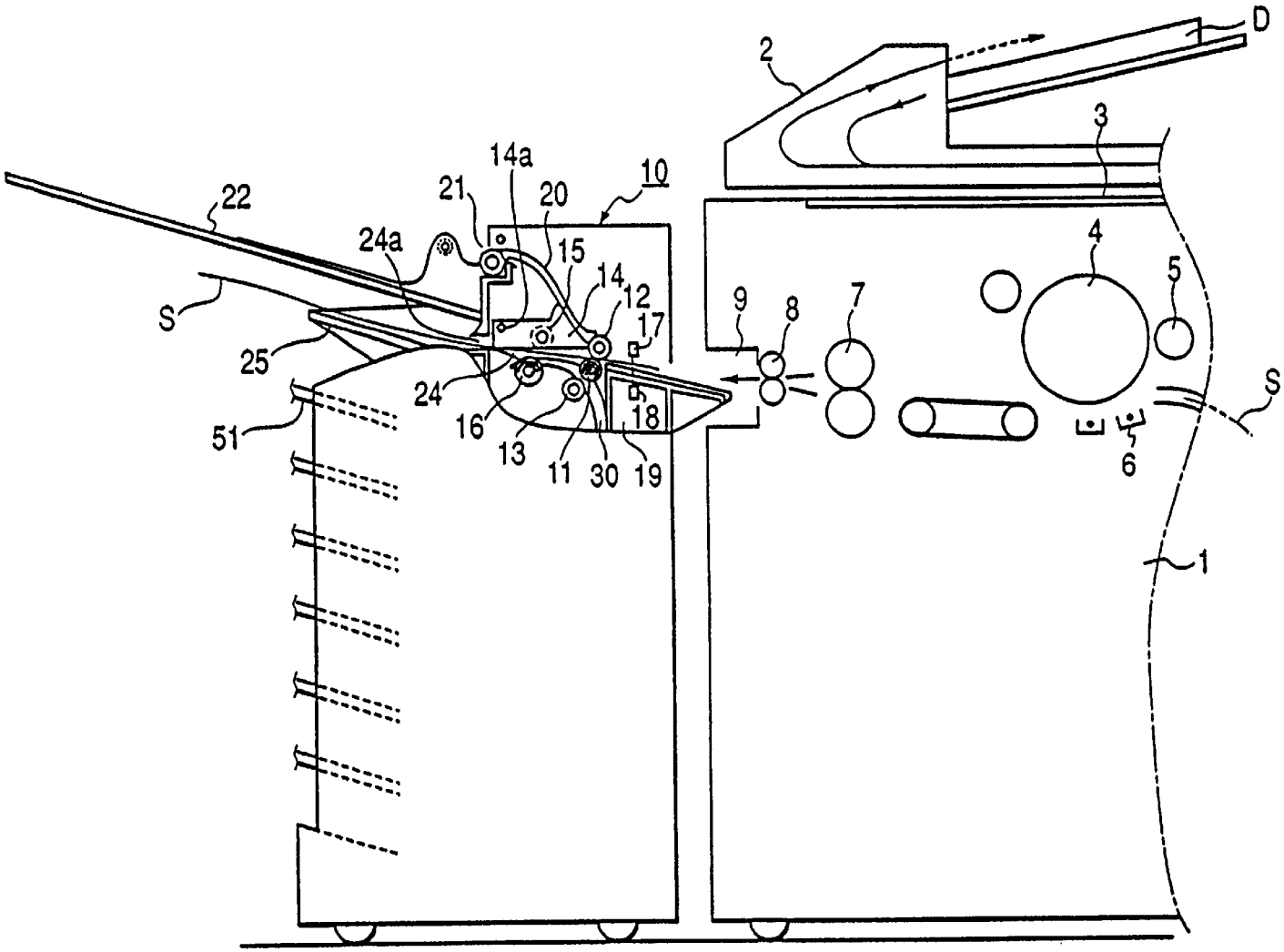
FIG. 3 is a schematic elevational sectional view of an image forming apparatus to which the sheet material stacking device according to the present invention can be applied.

As shown in FIG. 3, an automatic original feeding device 2 for automatically circulating originals D is rested on an upper surface of a main body of the image forming apparatus 1. Further, a sheet material stacking device 10 having a tray 22 for discharging a sheet material in a face-up fashion and a plurality of stacking trays 51 for discharging a sheet material in a face-down fashion and the like disposed at a downstream side (left in FIG. 3) of the image forming apparatus.

The image forming apparatus 1 is of electrophotographic type which is well-known in the art (thus, a detailed explanation thereof will be omitted). In the image forming apparatus, an image of the original D rested on a platen glass 3 is imaged on a photosensitive drum 4 as a latent image by an optical system (not shown), and the latent image is developed by a developing device 5 as a visual image (toner image). In synchronism with this, a sheet material S is supplied to an image forming means including the photosensitive drum 4 by a feeding means such as a feeding roller. The toner image on the photosensitive drum 4 is transferred onto the sheet material S by a transferring device 6. Then, the sheet material is sent to a fixing device 7, where the toner image is permanently fixed to the sheet material.

The sheet materials S on which the image was formed in this way are normally stacked on the stacking tray 51 successively in a face-up (imaged surface facing upwardly) fashion by a pair of discharge rollers (discharging means) 8. However, when the image formation is effected in a page sequence (for example, for 10 pages, from a first page to a tenth page), if the imaged sheet materials are successively stacking in the face-up fashion, the sheet materials are stacked in a sequence opposite to the page sequence. In order to stack the sheet materials in the page sequence, the sheet material stacking device 10 (described later) is mounted in the vicinity of a discharge opening 9 of the main body 1 of the image forming apparatus. By using this device, when the image formation is effected in the sequence opposite to the page sequence, the sheet materials can successively be stacked on a stacking tray 22 with the imaged surfaces facing upwardly (the face-up fashion), and, when the image formation is effected in the page sequence, the sheet materials can successively be stacked with the imaged surfaces facing downwardly (face-down fashion) while reversing a front surface and a rear surface of the sheet material to order the imaged sheet materials in the page sequence.

[Construction of Sheet Material Stacking Device]

Figure 1:
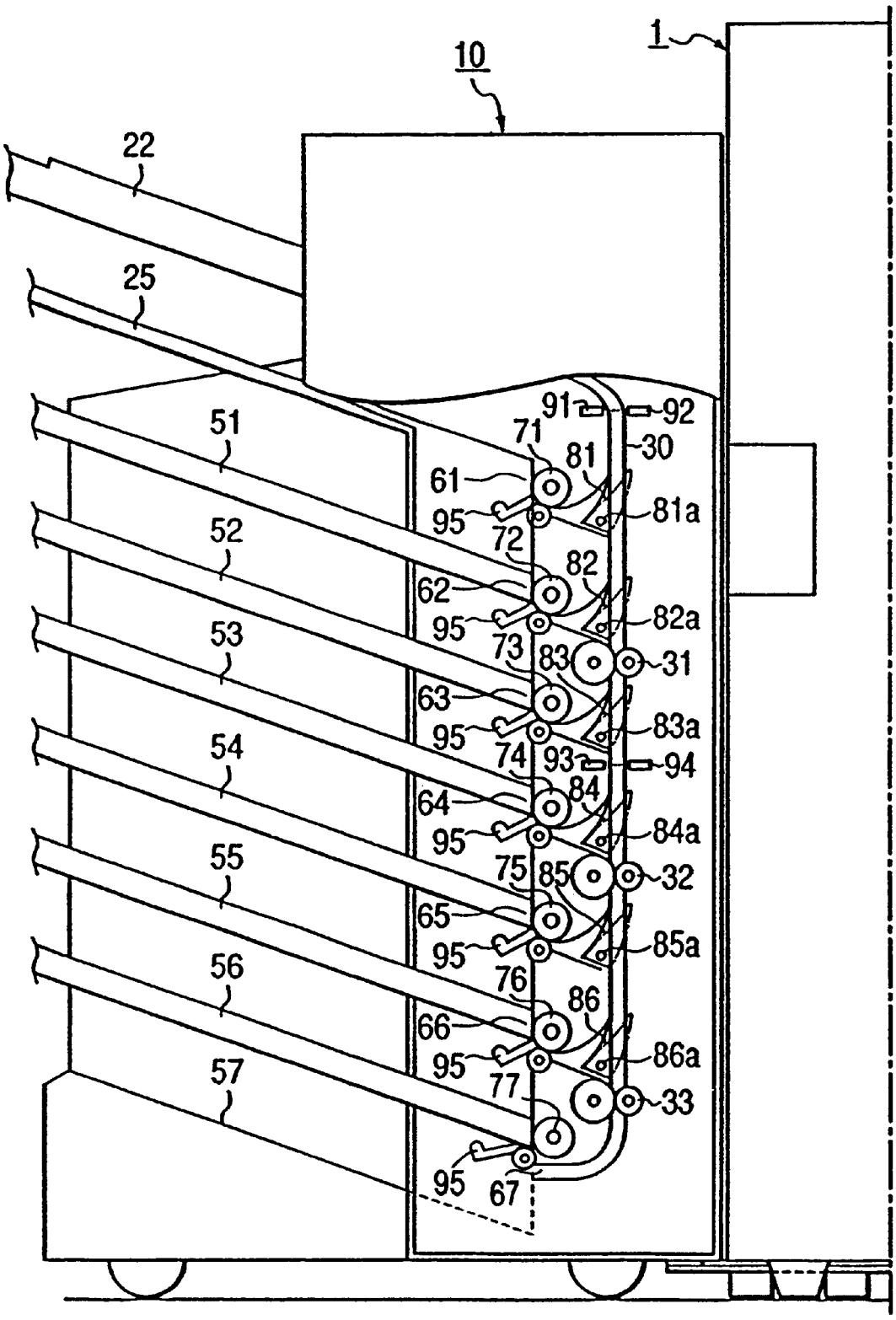
FIG. 1 is an elevational sectional view of a sheet material stacking device according to the present invention.
Figure 2:
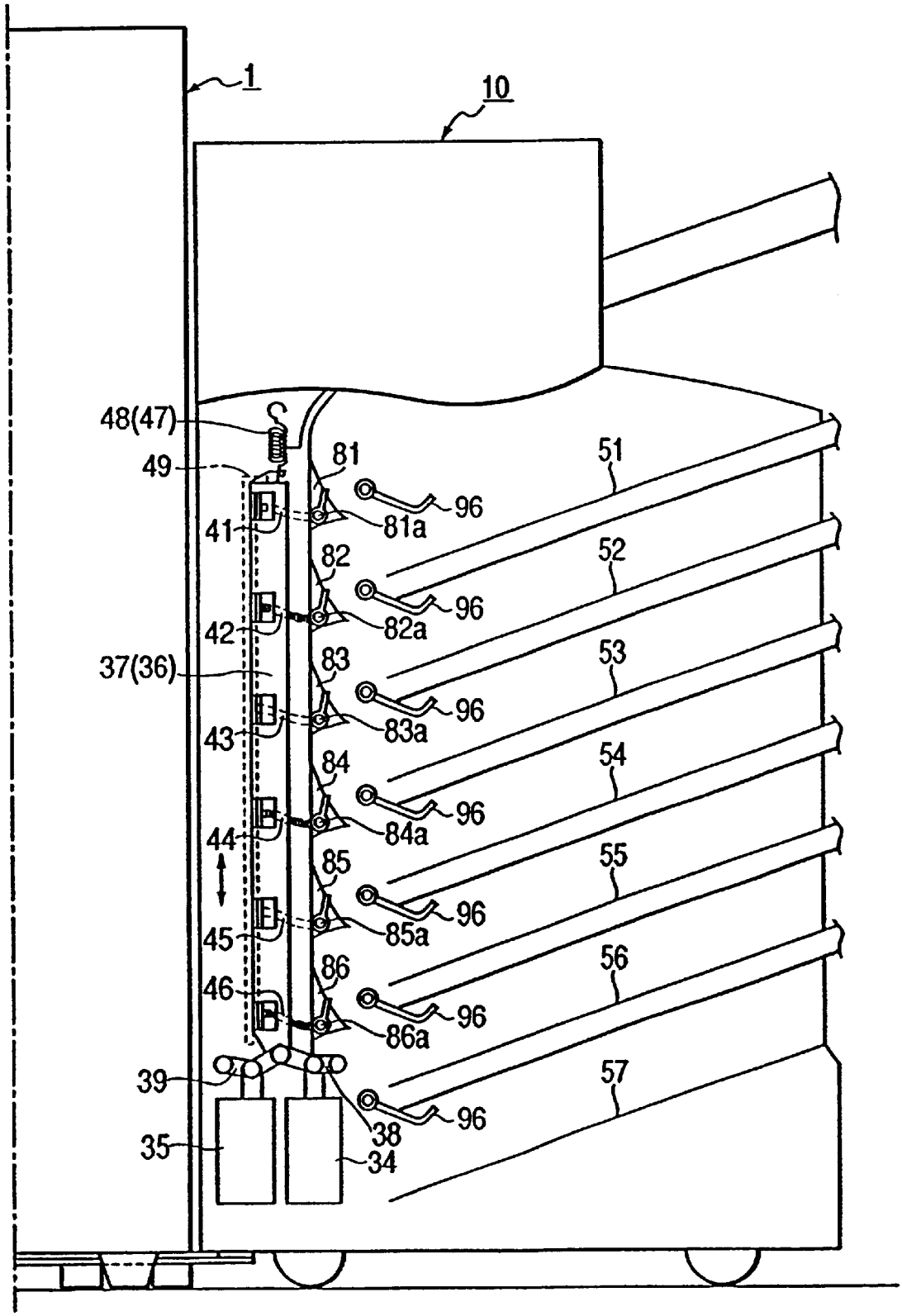
FIG. 2 is an elevational sectional view of a sheet material stacking device according to the present invention.

Next, a construction of the sheet material stacking device 10 will be fully explained with reference to FIGS. 1 to 3. FIGS. 1 and 2 are sectional views showing a schematic construction of the sheet material stacking device according to the present invention.

In FIG. 3, in order to convey the sheet material after it was fed-in and the front surface and the rear surface of the sheet material was reversed, a plurality (two in the illustrated embodiment) of rotatable conveying rollers 12, 13 abut against an outer surface of a conveying roller 11 rotated in a given direction (shown by the arrow in FIG. 3). The conveying roller 11 and the roller 12 abutting against the roller from the above acts as a pair of feed-in rollers for feeding-in the sheet material S, and, the conveying roller 11 and the roller 13 abutting against the roller from the below acts as a pair of feed-out rollers for feeding-out the sheet material S. That is to say, the sheet material S is fed-in by the pair of feed-in rollers 11, 12 and is fed-out by the pair of feed-out rollers 11, 13.

A guide member 19 directs the sheet material S discharged from the discharge opening 9 of the image forming apparatus 1 to a nip of the pair of feed-in rollers 11, 12. The guide member 19 can be rocked around the conveying roller 11 in accordance with a sheet material discharging position (positions of the discharge opening and a nip of the pair of discharging rollers) of the main body 1 of the image forming apparatus. Accordingly, by rocking the guide member 19 on demand, the sheet material stacking device can accommodate various image forming apparatuses having different sheet material discharging positions.

A flapper (switching means) 14 is disposed at a downstream side of the pair of feed-in rollers 11, 12 and can selectively be switched around a rotational center shaft 14a by an actuator means such as a solenoid (not shown) between an upper position shown by the solid line in FIG. 3 and a lower position. That is to say, a plurality of conveying paths located at the downstream side of the conveying roller 11 can selectively be switched by the flapper 14. More specifically, when the flapper 14 is switched to the solid line position (upper position) in FIG. 3, the sheet material S is guided into a reversing path 24. On the other hand, when the flapper 14 is switched to the lower position, the sheet material S is guided into a discharging path 20 with the imaged surface facing upwardly (face-up condition) without reversing the front surface and the rear surface of the sheet material. Accordingly, by selectively switching the flapper 14, the face-up stacking and the face-down stacking can be selected.

The discharging path 20 includes a pair of discharging rollers 21 for discharging the sheet material S onto a face-up discharging stacking tray 22 out of the device. The stacking tray 22 is detachably attached to the sheet material stacking device 10, and the sheet materials S discharged by the pair of discharging rollers 21 are successively stacked on the stacking tray 22.

A feed-back roller 16 is always rotated in a direction (shown by the arrow) opposite to that of the conveying roller 11 to feed-out the sheet material S fed-in the reversing path 24. The feed-back roller 16 is disposed below an extension line of a tangential line of the nip of the pair of feed-in rollers 11, 12 and nearer the pair of feed-in rollers 11, 12 than a position to which the leading end of the sheet material S fed-in from the pair of feed-in rollers 11, 12 reaches. Accordingly, the sheet material S guided by the flapper 14 switched to the solid line position in FIG. 3 is fed-in the reversing path 24 without contacting with the feed-back roller 16.

Further, a roller 15 as a driven rotary member is rotatably attached to a portion of the flapper 14 opposed to the feed-back roller 16. Thus, when the flapper 14 is switched to the lower position, the roller 15 is urged against the feed-back roller 16 to be rotated by the rotation of the feed-back roller, and, when the flapper 14 is switched to the solid line position in FIG. 3, the roller 15 is spaced apart from the feed-back roller 16.

That is to say, the sheet material S fed into the reversing path 24 by the flapper 14 switched to the solid line position in FIG. 3 is temporarily discharged onto a reversing tray 25 through a temporary discharge opening 24*a* without contacting the leading end of the sheet material with the feed-back roller 16. In this case, although the sheet material S is temporarily exposed out of the apparatus, since the temporary discharge opening 24*a* is located between the stacking tray 22 and the face-down discharging stacking tray 51 (described later), the sheet material S temporarily exposed out of the apparatus through the temporary discharge opening 24*a* is protected by the stacking trays 22, 51 to prevent the user from touching the sheet material.

Therefore, skew-feeding and damage of the sheet material S which may be caused by contacting the user with the sheet material can be prevented, thereby achieving the smooth reversing and conveyance of the sheet material. Further, since the sheet material S temporarily exposed is concealed by the stacking trays 22, 51, a neat appearance during operation is maintained.

The reversing tray 25 disposed below the temporary discharge opening 24*a* prevents the sheet material S temporarily discharged from contacting with the sheet materials S already stacked on the face-down discharging stacking tray 51. Thus, disordering or misalignment of the sheet materials S stacked on the stacking tray 51 due to the above contact can be prevented, thereby maintaining a neat stacking condition.

Sensors (detecting means) 17, 18 for detecting a trailing end of the sheet material S are disposed at an upstream side of the pair of feed-in rollers 11, 12. In the face-down discharging, when the trailing end of the sheet material S is detected by the sensors 17, 18, the flapper 14 is switched from the solid line position in FIG. 3 to the lower position by the actuator means such as a solenoid in response to a detection signal from the sensors. Accordingly, a tip end of the flapper 14 is smoothly shifted from the nip of the pair of feed-in rollers 11, 12 to a nip of the pair of feed-out rollers 11, 13.

The sheet material S is pushed toward the feed-back roller 16 by the switching (lowering) action of the flapper 14. That is to say, when the flapper 14 is switched from the solid line position in FIG. 3 to the lower position, the roller 15 of the flapper 14 abuts against the feed-back roller 16 to pinch the sheet material S between the feed-back roller 16 and the roller 15, thereby conveying the sheet material toward the pair of feed-out rollers 11, 13 in a direction opposite to the conveying-in direction.

The sheet material fed-out by the pair of feed-out rollers 11, 13 is directed to one of a plurality (seven in the illustrated embodiment) of downstream discharge openings 61 to 67, from which the sheet material is discharged onto one of the stacking trays 51 to 57 with the imaged surface facing downwardly (face-down condition). For example, when a discharged command for the uppermost stacking tray 51 is emitted, the flapper 14 is switched from the solid line position in FIG. 3 to the lower position, and the sheet material is discharged onto the stacking tray 51 by a pair of discharging rollers 71 disposed in the vicinity of the uppermost discharge opening 61. In this case, the sheet materials S are successively discharged with imaged surfaces facing downwardly (i.e., in the image forming sequence).

Now, a case where a plurality of sheet materials are continuously fed-in and are successively stacked on the stacking tray 51 will be explained. When the trailing end of the sheet material is detected by the sensors 17, 18, at a timing when the trailing end of the sheet material leaves the sensors 17, 18, the flapper 14 is lowered as mentioned above to direct the sheet material to the nip of the pair of feed-out rollers 11, 13, and the sheet material is pinched between the pair of feed-back rollers 15, 16 to be conveyed to the pair of feed-out rollers 11, 13.

As shown in FIG. 3, the flapper 14 is designed so that the tip end of the flapper is overlapped with the conveying roller 11 in an axial direction. Accordingly, the sheet material can be conveyed effectively due to friction between the tip end of the flapper 14 and the conveying roller 11, and the flapper 14 also act as a guide for guiding the sheet material to the pair of feed-out rollers 11, 13 to direct the sheet material to the nip of the pair of feed-out rollers 11, 13 smoothly. When the lowered position of the tip end of the flapper 14 is selected to become lower than the rotation center of the conveying roller 11, the leading end (trailing end prior to the reversing of the front surface and the rear surface of the sheet material) of the sheet material is directed to the nip of the pair of feed-out rollers 11, 13 more smoothly without abutting against the conveying roller 11.

Explaining in more detail, the trailing end of the sheet material left the nip of the pair of feed-in rollers 11, 12 is urged against the conveying roller 11 by the tip end of the rockable flapper 14, and the sheet material is conveyed in the same direction by the rotational friction force of the conveying roller 11 even after the sheet material leaves the nip of the pair of feed-in rollers 11, 12. This conveyance continues up to a position where the friction force of the conveying roller 11 disappears, i.e., a position where the tip end of the lowered flapper 14 contacts with the conveying roller 11 with the interposition of the sheet material. When the trailing end of the sheet material leaves such a position, the flapper 14 is further lowered. When the sheet material is fed back while being pinched between the pair of feed-back rollers 15, 16, the trailing end of the sheet material has already ridden over the conveying roller 11, so that the sheet material can smoothly be directed to the nip of the pair of feed-out rollers 11, 13.

When the tip end (trailing end prior to the reversing of the front surface and the rear surface of the sheet material) of the sheet material is pinched between the pair of feed-out rollers 11, 13, the flapper 14 is lifted to separate the roller 15 from the feed-back roller 16. At this timing, a leading end of a next (succeeding) sheet material is pinched between the pair of feed-in rollers 11, 12 and then is directed to the reversing path 24. Accordingly, the succeeding sheet material is directed to the temporary discharge opening 24*a* along the upper surface (imaged surface) of the preceding sheet material without contacting with the feed-back roller 16. When the trailing end (leading end prior to the reversing of the front surface and the rear surface of the sheet material) of the preceding sheet material leaves the nip of the pair of feed-out rollers 11, 13, the trailing end of the succeeding sheet material is detected by the sensors 17, 18. When the trailing end of the succeeding sheet material leaves the nip of the pair of feed-in rollers 11, 12, the similar reversing operation is repeated .

Therefore, the continuously fed sheet materials can surely be conveyed at a high speed while reversing the front surface and the rear surface thereof, and, thus, the sheet material stacking device particularly suitable for an image forming apparatus capable of effecting the image formation at a high speed can be provided. Since the conveying roller 11 and the feed-back roller 16 are rotated in their given directions, unlike the conventional devices, a complicated driving mechanism for reversibly rotating the rollers and a control means therefor are not required, thereby providing a less expensive device.

[Construction of Sorting Mechanism]

Next, a mechanism for sorting the sheet materials onto the stacking trays will be fully explained with reference to FIGS. 1 and 2. In the illustrated embodiment, as shown in FIGS. 1 and 2, while a sheet material stacking device having seven face-down discharging stacking trays was illustrated, the present invention is not limited to such a device, but, the number of the face-down discharging stacking trays can be suitably selected on demand.

First of all, the entire construction of the sheet material stacking device 10 will be explained with reference to FIGS. 1 and 2. In FIGS. 1 and 2, the stacking trays (sheet material stacking means) 51 to 57 comprises bins for stacking and holding the sheet materials fed out from the discharge openings 61 to 67.

Pairs of discharging rollers (discharging means) 71 to 76 serve to feed out the sheet materials onto the associated stacking trays 51 to 56.

A common convey path 30 serves to convey the recorded sheet materials to sorting portions (portions branched from the common convey path to the respective stacking trays) vertically and is defined by both guide members extending substantially in parallel with an overlapped direction of the stacking trays 51 to 57.

[Explanation of Pairs of Conveying Rollers in Common Convey Path]

The common convey path 30 includes a plurality (three in the illustrated embodiment) of pairs of conveying rollers 31 to 33 equidistantly spaced apart from each other, the number of pairs being smaller than the number of flappers 81 to 86. The sheet material is conveyed vertically (from above to below in FIG. 1) through the common convey path 30 by the pairs of conveying rollers 31 to 33.

In the illustrated embodiment, the three pairs of conveying rollers 31 to 33 are disposed immediately at a downstream side of three alternate flappers (second, fourth and sixth flappers 82, 84, 86 which will be described later). This arrangement simplifies the construction in comparison with a case where a pair of conveying rollers are provided immediately at a downstream side of all of flappers.

The flappers 81 to 86 act as switching members to direct the sheet material to a desired one of the pairs of discharging rollers 71 to 76. The flappers 81 to 86 have rotation centers 81*a* to 86*a* offset from the common convey path 30 toward the respective discharge openings so that each of the flappers can be rocked between a closed position (shown by the solid line in FIG. 1) where the common convey path 30 is not blocked by the flapper and an open position (shown by the chain double-dashed line) the common convey path 30 is blocked by the flapper.

Solenoids (actuator means) 34, 35 (FIG. 2) serve to selectively rock the flappers 81 to 86. The solenoid 34 selectively rocks alternate first, third and fifth flappers 81, 83, 85 and the solenoid 35 selectively rocks alternate second, fourth and sixth flappers 82, 84, 86. The solenoids are mounted side by side on a lower frame (not shown) of the sheet material stacking device 10.

With an arrangement as mentioned above, the construction of the sheet material stacking device is simplified, thereby preventing the device from becoming expensive and bulky. For example, although the plurality of flappers can be rocked by a single solenoid, in this case, control for open/close timing of the flappers becomes difficult in comparison with the illustrated embodiment.

Link members (connection means) 36, 37 are connected to movable portions of the solenoids 34, 35 via arm members 38, 39 rockably attached to the frame (not shown) of the sheet material stacking device 10 so that the link members are operated integrally with the movable portions of the solenoids 34, 35 to be rocked in an up-and-down direction in FIG. 2.

Each of tension springs 47, 48 has one end locked to a hook portion of the link member 38 or 39 and the other end locked to a hook portion of the frame of the device. When the solenoids 34, 35 are in OFF conditions, the link members 36, 37 are lifted upwardly (FIG. 2) by the tension forces of the tension springs.

[Operation of Flappers]

Next, the operation of the flappers during the sheet material sorting will be described. FIGS. 1 and 2 show a solenoid OFF condition. In the condition that the solenoids 34, 35 are OFF, the link members 36, 37 are urged against an upper stopper 49 by the tension forces of the tension springs 47, 48 and are stopped there. Accordingly, the flappers 81 to 86 are in their closed positions (shown by the solid lines in FIG. 1) where they do not block the common convey path 30 and form a part of the guide member defining the common convey path 30. In this case, the flappers 81 to 86 are biased by biasing forces of compression springs 41 to 46 toward clockwise directions in FIG. 2 (closing directions) around the rotation centers 81*a* to 86*a*.

Now, for example, when the solenoid 34 (or solenoid 35) is turned ON, the link member 36 (or link member 37) is shifted downwardly (shown by the downwardly directed arrow in FIG. 2) in opposition to the tension force of the tension spring 47 (or tension spring 48), with the result that the first, third and fifth flappers 81, 83, 85 (or second, fourth and sixth flappers 82, 84, 86) are rocked in counter-clockwise directions in FIG. 2 to reach the open positions (shown by the chain double-dashing lines in FIG. 1) for blocking the common convey path 30. In this case, the first, third and fifth flappers 81, 83, 85 (or second, fourth and sixth flappers 82, 84, 86) are biased by the biasing forces of compression springs 41, 43, 45 (or compression springs 42, 44, 46) toward counter-clockwise directions in FIG. 2 (opening directions) around the rotation centers 81*a*, 83*a*, 85*a* (or rotation centers 82*a*, 84*a*, 86*a*).

[Explanation of Upper and Lower Sensors]

The common convey path 30 further includes upper sensors (first detecting means) 91, 92 for detecting the sheet material to control the open/close timing of the flappers, and lower sensors (second detecting means) 93, 94 for detecting the sheet material jam. The lower sensors 93, 94 also act to detect the sheet material to control the open/close timing of the flappers. In the illustrated embodiment, the open/close timing of the first to fourth flappers 81, 82, 83, 84 is controlled on the basis of a sheet material detection signal from the upper sensors 91, 92, and the open/close timing of the fifth and sixth flappers 85, 86 is controlled on the basis of a sheet material detection signal from the lower sensors 93, 94.

The upper sensors 91, 92 are disposed at an upstream side of the uppermost first flapper 81 (for example, at an upstream side of the tip end of the flapper 81 by about 30 mm), and the lower sensors 93, 94 are disposed at a downstream side of the upper sensors 91, 92 with a predetermined distance (smallest size of the sheet material+$\alpha$ (larger than the smallest size of the sheet material by $\alpha$)) therebetween. With this arrangement, the sheet material jam can surely be detected, and the open/close timing of the flappers for directing the sheet materials to the stacking trays can surely be controlled without any error.

[Example of Sorting Operation]

Next, for explaining a series of operations, an example that the sheet materials are sorted and conveyed to the fourth stacking tray 54 (for example) will be described.

The sheet material on which the image was formed by the image forming apparatus 1 is transferred to the sheet material stacking device 10, where, after the front surface and the rear surface of the sheet material is reversed, the leading end (trailing end prior to the reversing of the front surface and the rear surface of the sheet material) of the sheet material is detected by the upper sensors 91, 92 at the inlet of the common convey path 30. Then, the sheet material is conveyed downwardly through the common convey path 30 at a predetermined speed by the pair of conveying rollers 31. On the detection signal from the sensors 91, 92, at a timing when the leading end of the sheet material passes through the third flapper 83, the solenoid 35 is turned ON.

When the solenoid 35 is turned ON, the link member 37 is pulled downwardly in FIG. 2 with the result that the second, fourth and sixth flappers 82, 84, 86 are rocked in the counter-clockwise directions in FIG. 2. The biasing force of the compression spring 42 for connecting the second flapper 82 to the link member 37 is selected to a value sufficient to be greater than the rocking resistance of the flapper 82 and smaller than rigidity of the sheet material being conveyed. Thus, during the rocking movement of the second flapper 82 to the open position where the common convey path 30 is blocked, when the tip end of the flapper abuts against the sheet material being conveyed through the common convey path 30, due to the rigidity of the sheet material, the flapper 82 is stopped in opposition to the biasing force of the compression spring 42 at the position where the flapper abuts against the sheet material without blocking the common convey path 30.

On the other hand, the fourth flapper 84 (and the sixth flapper 86) are rocked to the open positions where the common convey path 30 is blocked. The sheet material is conveyed downwardly by the pair of the conveying rollers 31 of the common convey path 30 until it abuts against the fourth flapper 84 rocked to the open position. In this case, since a force obtained by abutting the leading end of the sheet material against the fourth flapper 84 is oriented to a direction tending to rotate the flapper 84 in the counter-clockwise direction in FIG. 2, the sheet material is positively guided toward the fourth pair of discharging rollers 74, with the result that the sheet material is discharged onto the fourth stacking tray 54 by the pair of discharging rollers 74.

In this case, although the sheet material is slidingly contacted with the tip end of the second flapper 82, since the tip end (contacted with the sheet material) of the second flapper 82 has a round-configuration as shown, the sheet material is smoothly slid frictionally without being caught by the tip end of the flapper and is conveyed downwardly by the pair of conveying rollers 31 disposed at the downstream side of the flapper 82.

Although not explained here, the operations of the third flapper 83, fifth flapper 85 and sixth flapper 86 for guiding the sheet material to the discharge openings 63, 65, 66 are the same as the above-mentioned operation. Further, the biasing forces of the compression springs 41, 43, 44, 45, 46 are similarly set to the biasing force of the compression spring 42. Similar to the flapper 82, the tip ends (contacted with the sheet material) of the flappers 81, 83, 84, 85, 86 have round configurations.

With the arrangement as mentioned above, when the sheet material is discharged onto the lowermost (seventh in the illustrated embodiment) stacking tray 57, all of the flappers are not operated (the solenoids 34, 35 are in the OFF conditions), with the result that the sheet material is directed to the discharge opening 67 through the common convey path 30, where the sheet material is discharged onto the stacking tray 57 by the pair of discharging rollers 77.

By adopting the arrangement in which the alternate three flappers are operated by one solenoid as mentioned above, when the sheet material is guided toward the pair of discharging rollers by the third or fourth flapper 83 or 84, the sheet material is slidingly contacted with the first or second flapper 81 or 82, and, when the sheet material is guided toward the pair of discharging rollers by the fifth or sixth flapper 85 or 86, the sheet material is slidingly contacted with the first and third flappers 81, 83 or the second and fourth flappers 82, 84. In order to prevent the sheet material from being restrained due to the sliding contact between the sheet material and the flappers, the pairs of conveying rollers 31 to 33 disposed in the common convey path 30 are set to have conveying forces sufficiently greater than the sliding resistance.

Sheet pressing levers 95, 96 are arranged in a widthwise direction of a sheet to correct curling of the sheet. As mentioned above, since the compression springs 41 to 46 are interposed between the flappers 81 to 86 and the link members 36, 37 connected to the solenoids 34, 35 in the transverse direction (substantially perpendicular to the common convey path 30) to rock the flappers 81 to 86 by the compression springs 41 to 46, even when the alternate three flappers are operated by one solenoid, the flappers other than the flapper effecting the sorting operation (flapper blocking the common convey path) do not restrain the sheet material. Accordingly, a sheet material stacking device which is cheaper and more compact, can effect stable sheet material conveyance and has high reliability can be provided.

Next, a stacking tray having an extension tray according to the present invention will be explained with reference to FIGS. 4A, 4B, 4C and FIGS. 5A and 5B.

Figure 4A:
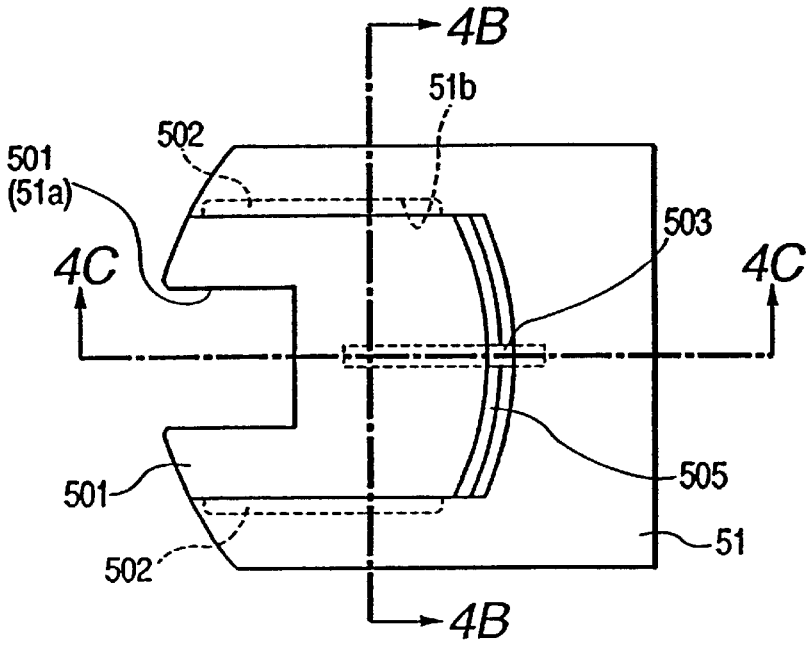
FIG. 4A is a plan view showing a sheet material stacking tray portion which is a main part of the sheet material stacking device according to the present invention.
Figure 5A:
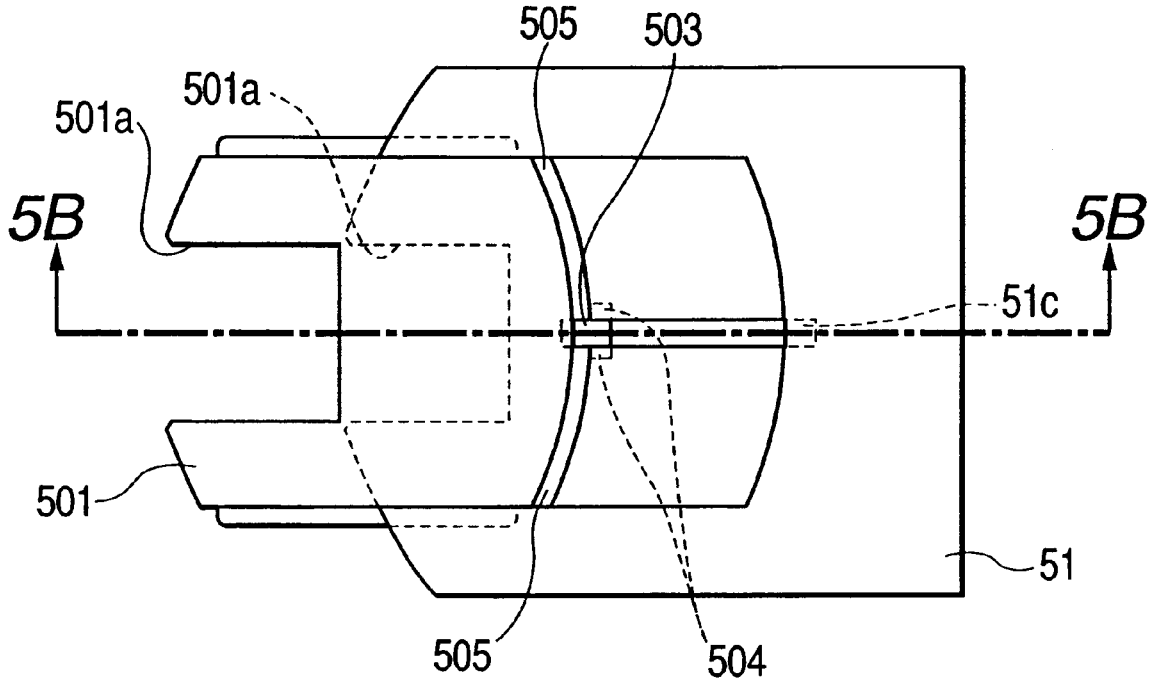
FIG. 5A is a plan view for explaining an operation of the sheet material stacking tray portion of FIG. 4A.

FIG. 4A is a plan view showing a stacking tray (sheet material stacking means) 51, and an extension (elongation) tray (extension stacking means) 501 expansibly (retractably) mounted to the stacking tray 51, and FIG. 5A is a plan view showing a condition that the extension tray 501 is extended.

The extension tray 501 is provided at its both lateral (upper and lower in FIG. 4A or 5A) edges with guide ridges 502. By slidingly fitting the guide ridges 502 into corresponding guide grooves 51*b* of the stacking tray 51, the extension tray 501 can be expanded and contracted with respect to the stacking tray 51.

Figure 4B:
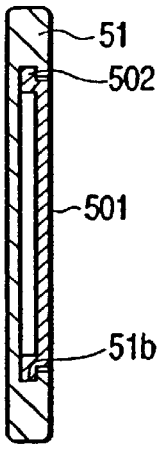
FIG. 4B is a sectional view taken along the line 4B—4B in FIG. 4A.

A recess portion opened upwardly and extending from a substantially central portion of the stacking tray 51 toward a downstream side is formed in the stacking tray 51. The extension tray 501 is mounted to the stacking tray 51 in such a manner that the extension tray is housed within the recess portion. As shown in FIG. 4B, a sheet material stacking surface of the extension tray 501 is flush with the stacking surface of the stacking tray 51. The stacking tray 51 and the extension tray 501 have notches 51*a*, 501*a* for facilitating the removal of the stacked sheet materials.

An upstream end (right end in FIG. 4A) of the extension tray 501 has a convex curvature and an upstream end of the recess portion of the stacking tray 51 has a corresponding concave curvature. The upstream end of the extension tray 501 has an inclined surface 505 which is curved along the convex curvature, as shown in FIG. 4A.

The inclined surface 505 has a stepped portion 503 at its width-wise (transverse to the sheet material conveying direction) central portion thereof, which stepped portion is slightly protruded from the inclined surface 505 toward the upstream side. The stepped portion 503 serves to prevent the leading end of the sheet material being discharged onto the stacking tray 51 from being caught by the extension tray 501. The stepped portion 503 is protruded from the inclined surface 505 by about 1 mm or 2 mm.

Figure 4C:
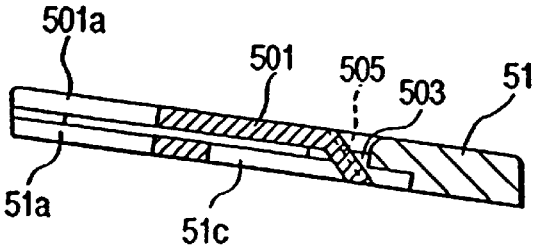
FIG. 4C is a sectional view taken along the line 4C—4C in FIG. 4A.

As shown in FIG. 4C, the stepped portion 503 is further extended downwardly to be fitted into an elongated slot 51*c* formed in the rear surface of the stacking tray 51, and, as shown in FIG. 5A, there are provided a pair of projections 504 extending from the extension of the stepped portion 503 in the width-wise direction. The projections 504 are slidingly contacted with the rear surface of the stacking tray 51 on both sides of the elongated slot 51*c*. The stacking tray 51 is pinched between the guide ridges 502 and the projections 504.

The projections 504 serve to prevent the sheet material from being pinched in a space between the stacking tray 51 and the stepped portion 503 of the extension tray 501. Since the projections 504 are contacted with the rear surface of the stacking tray 51, when the extension tray 501 is extended, camber of the extension tray 501 and formation of space therefor can be prevented.

Figure 5B:
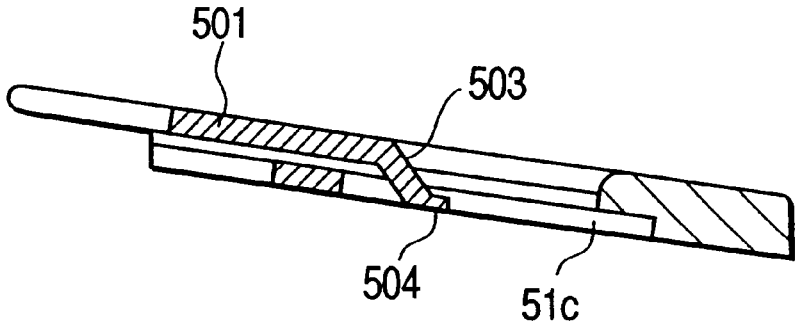
FIG. 5B is a sectional view taken along the line 5B—5B in FIG. 5A.
Figure 6:
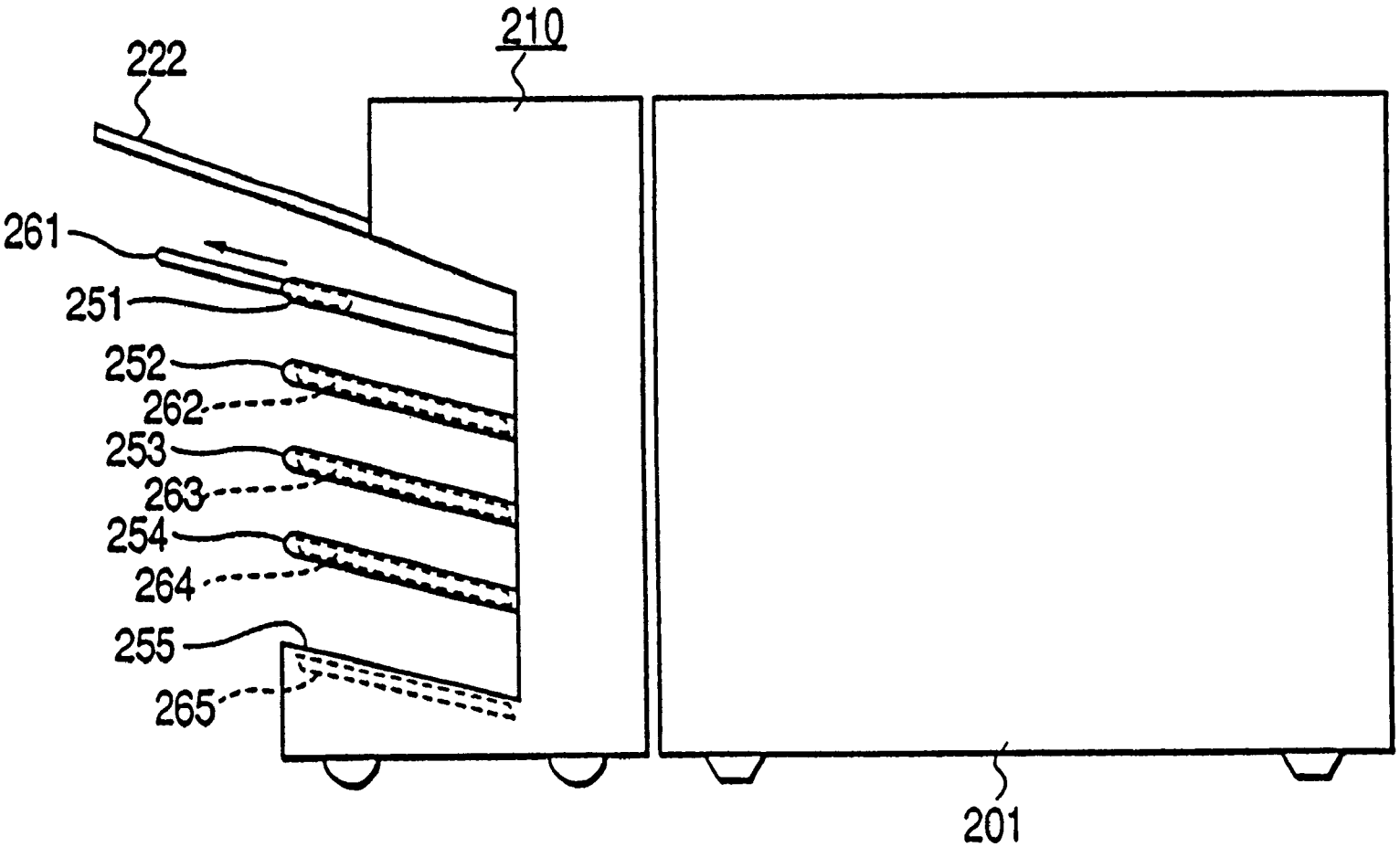
FIG. 6 PRIOR ART
FIG. 6 is a schematic side view of an image forming apparatus having a conventional sheet material stacking device.
Figure 7:
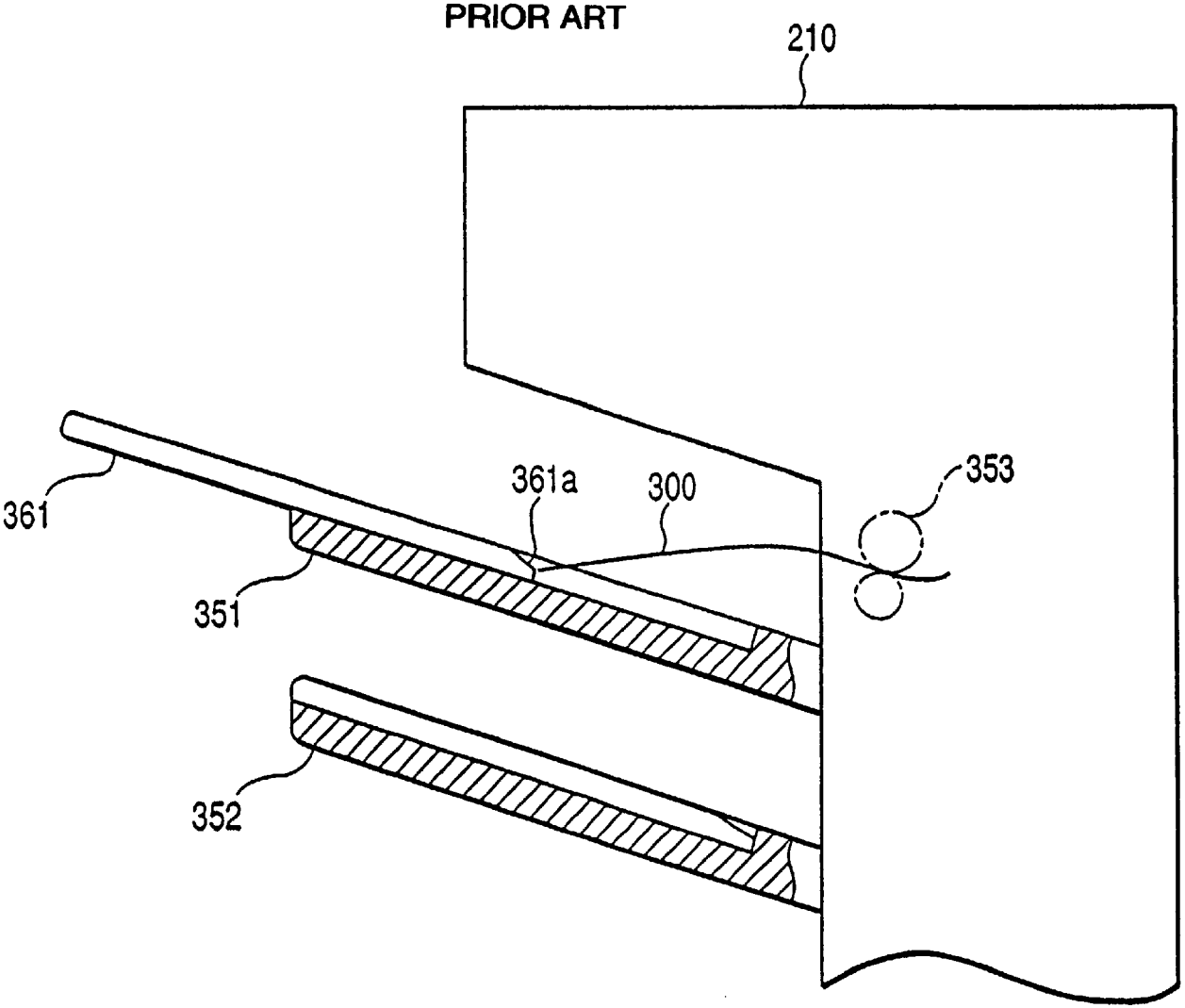
FIG. 7 PRIOR ART
FIG. 7 is an elevational sectional view for explaining an operation of a sheet material stacking tray portion of the conventional sheet material stacking device.

FIG. 5A is a plan view showing a condition that the extension tray 501 is extended when a large sized sheet material is discharged, and FIG. 5B is a sectional view taken along the line 5B—5B in FIG. 5A.

When the sheet material having a small size is discharged in the condition that the extension tray 501 is retracted into the stacking tray 51 as shown in FIGS. 4A to 4C, or when the sheet material having a large size is discharged in the condition that the extension tray 501 is extended as shown in FIGS. 5A and 5B, the discharged sheet material is received by the stepped portion 503 of the extension tray 501 and is smoothly rested on the stacking tray 51 and the extension tray 501 while being guided by the inclined surface 505.

As mentioned above, according to the present invention, since the extension stacking means can be extended and retracted with respect to the sheet material stacking means and the inclined surface is provided at the upstream end of the extension stacking means, the sheet material being discharged onto the sheet material stacking means can be prevented from being caught by the upstream end of the extension stacking means, thereby preventing the poor sheet material conveyance.

Further, since the stacking surface of the extension stacking means is flush with the stacking surface of the sheet material stacking means, a thin sheet material stacking means without catching the sheet material can be obtained, and installation space and the height of the device can be reduced.

What is claimed is:

1. A sheet material stacking device comprising:

a sheet material discharging means for discharging a sheet material;

a sheet material stacking means on which the sheet materials discharged by said sheet material discharging means are stacked; and an elongation stacking means housed and held within said sheet material stacking means for being elongated in accordance with a size of the sheet material discharged;

wherein said elongation stacking means has an inclined surface at an upstream end thereof in a sheet material stacking direction.

2. A sheet material stacking device according to claim 1, wherein said inclined surface of said elongation stacking means is an inclined surface sloped from a downstream side to an upstream side in the sheet material stacking direction.

3. A sheet material stacking device according to claim 1, wherein said upstream end of said elongation stacking means in the sheet material stacking direction has a convex curvature from a downstream side to an upstream side in the sheet material stacking direction.

4. A sheet material stacking device according to any one of claims 1 to 3, wherein said inclined surface of said elongation stacking means has projections contacted with a rear surface of said sheet material stacking means to slide frictionally on said elongation stacking means, at an upstream end thereof in the sheet material stacking direction.

5. A sheet material stacking device according to any one of claims 1 to 3, wherein a stacking surface of said elongation stacking means is flush with a stacking surface of said sheet material stacking means.

6. An image forming apparatus comprising:

a sheet material stacking device including:

a sheet material discharging means for discharging a sheet material;

a sheet material stacking means on which the sheet materials discharged by said sheet material discharging means are stacked; and an elongation stacking means housed and held within said sheet material stacking means for being elongated in accordance with a size of the sheet material discharged, wherein said elongation stacking means has an inclined surface at an upstream end thereof in a sheet material stacking direction; and an image forming means for forming an image on a sheet material;

wherein the sheet material on which the image was formed by said image forming means is discharged onto said sheet material stacking device.

7. A sheet material stacking device according to claim 6, wherein said inclined surface of said elongation stacking means is an inclined surface sloped from a downstream side to an upstream side in the sheet material stacking direction.

8. A sheet material stacking device according to claim 6, wherein said upstream end of said elongation stacking means in the sheet material stacking direction has a convex curvature from a downstream side to an upstream side in the sheet material stacking direction.

9. A sheet material stacking tray comprising:

a stacking tray on which sheet materials are stacked; and an elongation tray housed and held in said stacking tray for being elongated in accordance with a size of the sheet material stacked;

wherein said elongation tray has an inclined surface at an upstream end thereof in a sheet material stacking direction.

10. A sheet material stacking tray according to claim 9, wherein said inclined surface of said elongation stacking means is an inclined surface sloped from a downstream side to an upstream side in the sheet material stacking direction.

11. A sheet material stacking tray according to claim 9, wherein said upstream end of said elongation tray in the sheet material stacking direction has a convex curvature from a downstream side to an upstream side in a sheet material stacking direction.

12. A sheet material stacking tray according to any one of claims 9 to 11, wherein said inclined surface of said elongation tray has projections contacted with a rear surface of said stacking tray to slide frictionally said elongation tray, at an upstream end thereof in the sheet material stacking direction.

13. A sheet material stacking tray according to any one of claims 9 to 11, wherein a stacking surface of the sheet material of said elongation tray is flush with a stacking surface of said stacking tray.

* * * * *

UNITED STATES PATENT AND TRADEMARK OFFICE

CERTIFICATE OF CORRECTION

PATENT NO. : 6,286,830 B1
DATED : September 11, 2001
INVENTOR(S) : Yoshihiko Kitahara et al.

It is certified that error appears in the above-identified patent and that said Letters Patent is hereby corrected as shown below:

Column 2,
Line 18, "with" should be deleted.

Column 3,
Line 54, "was" should read -- were --.

Column 5,
Line 65, "act" should read -- acts --.

Column 6,
Line 17, "with" should be deleted.

Column 7,
Line 1, "comprises" should read -- comprise --; and
Line 10, "in" should be deleted.

Column 8,
Line 47, "material+α" should read -- material + α --; and
Line 60, "is" should read -- are --.

Signed and Sealed this

Ninth Day of April, 2002

*Attest:*

*Attesting Officer*

JAMES E. ROGAN
*Director of the United States Patent and Trademark Office*